United States Patent [19]

Macocco et al.

[11] Patent Number: 4,856,986

[45] Date of Patent: Aug. 15, 1989

[54] VERTICAL FURNACE FOR FIRING WIRE-LIKE PRODUCTS

[75] Inventors: Dino Macocco, Venaria Reale; Michele Riccó, Collegno, both of Italy

[73] Assignee: Societa' Industriale Costruzioni Microelettriche S.I.C.M.E. S.p.A., Turin, Italy

[21] Appl. No.: 150,031

[22] Filed: Jan. 29, 1988

[30] Foreign Application Priority Data

Jan. 30, 1987 [IT] Italy ..... 52927/87[U]

[51] Int. Cl.[4] ..... F23J 13/00; F27B 9/28

[52] U.S. Cl. ..... 432/72; 432/59; 126/108

[58] Field of Search ..... 126/108; 432/59, 125, 432/143, 148, 198; 148/156, 157

[56] References Cited

U.S. PATENT DOCUMENTS 4,303,387 12/1981 Burke et al. ..... 432/59 X 4,448,578 5/1984 Brunet et al. ..... 432/59 X

*Primary Examiner*—Larry Jones

*Attorney, Agent, or Firm*—Gifford, Groh, Sheridan, Sprinkle and Dolgorukov

[57] ABSTRACT

A furnace for firing electrically conductive wires clad with an insulating plastics resin, comprising a principal chamber defining a first portion in which evaporation of solvents from the resin takes place and a second portion in which this resin is polymerized and cross linked, and a diffuser element provided with separator means operable to divide the gas stream into a plurality of partial streams and means for distribution and introduction of these partial streams into a peripheral zone of the first portion in a direction substantially parallel to the lateral surface of the first portion itself.

15 Claims, 5 Drawing Sheets

VERTICAL FURNACE FOR FIRING WIRE-LIKE PRODUCTS

BACKGROUND OF THE INVENTION

The present invention relates to a furnace for firing wire-like products, and in particular to a vertical furnace for firing copper wire enamelled with a cladding of insulating plastics resin.

As is known, furnaces currently utilized for firing the cladding of copper wires are of the continuous tunnel type and include at least one chamber of elongate form in which the wire is advanced longitudinally. In a first portion of this chamber evaporation of the solvents which impregnate the cladding resin take place; in the second portion of the chamber, maintained at a higher temperature than that of the first portion, polymerization and cross linking of resin take place.

The heating of the said portions, and in particular of the first, is generally achieved by convection, that is to say by introducing a flow of hot gases at an appropriate flow rate and temperature; conveniently such gases are constituted at least in part by combustion products of the solvent vapours which are released in said first portion of the principal chamber, thus obtaining the dual function of lowering the toxicity of these vapours, which are transformed into carbon dioxide and steam, and re-using at least a part of the thermal energy which is generated during their combustion. Furnaces of the known type have several disadvantages.

First of all, the direct introduction of hot gases into the first portion of the principal chamber cannot take place at a very high speed in that it would cause surface non-uniformity (in particular undulations) on the cladding of the wire, making the electrical insulating characteristics of the wire itself irregular. Similarly, these gases cannot be introduced at a very high temperature; it can in fact be experimentally verified that an excessively high temperature, in combination with a relatively high speed of convection, causes surface imperfections on the cladding.

It is evident that this sets precise operational limits on the furnace since the speed of advancement of the wire (which determines the dwell time of each portion of wire in the first portion of the principal chamber) cannot be increased beyond certain limits which guarantee the complete evaporation of the solvents and the surface regularity of the cladding on the wire.

In the case of vertical furnaces, a further disadvantage is constituted by the tendency to suck in external air through the lower inlet opening by the chimney effect; this implies a lowering of the mean temperature within the first portion of the principal chamber and the consequent necessity to provide further thermal energy.

SUMMARY OF THE INVENTION

The object of the present invention is the provision of a furnace for firing copper wire clad with plastics resin which will be free from the above-mentioned disadvantages.

The object is achieved by the present invention in that it relates to a furnace for firing wire-like products, in particular copper clad wire with a plastics resin, of the type comprising:

a principal chamber of elongate form within which said products translate axially in a longitudinal direction between an inlet opening and an outlet opening, said principal chamber defining a first portion in which evaporation of solvents from the plastics resin take place and a second portion in which polymerization and cross linking of said plastics resin take place;

an auxiliary unit comprising an aspiration opening communicating with said principal chamber, aspiration means for drawing a first stream of air and solvent vapours from said principal chamber and means for heating the first stream to cause combustion of the vapours;

means for introducing a gas stream at least into said first portion of said principal chamber;

characterized by fact that the said means for introducing said gas stream comprise a diffuser provided with separator means operable to divide said gas stream into a plurality of partial streams, means for distribution of said partial streams, and means for introducing said partial streams into a peripheral region of said first portion of said principal chamber in a direction substantially parallel to at least one lateral surface of said first portion.

BRIEF DESCRIPTION OF THE DRAWINGS

For a better understanding of the present invention a preferred embodiment is now described purely by way of non-limitative example and with reference to the attached drawings, in which.

DETAILED DESCRIPTION OF THE INVENTION

Figure 1:
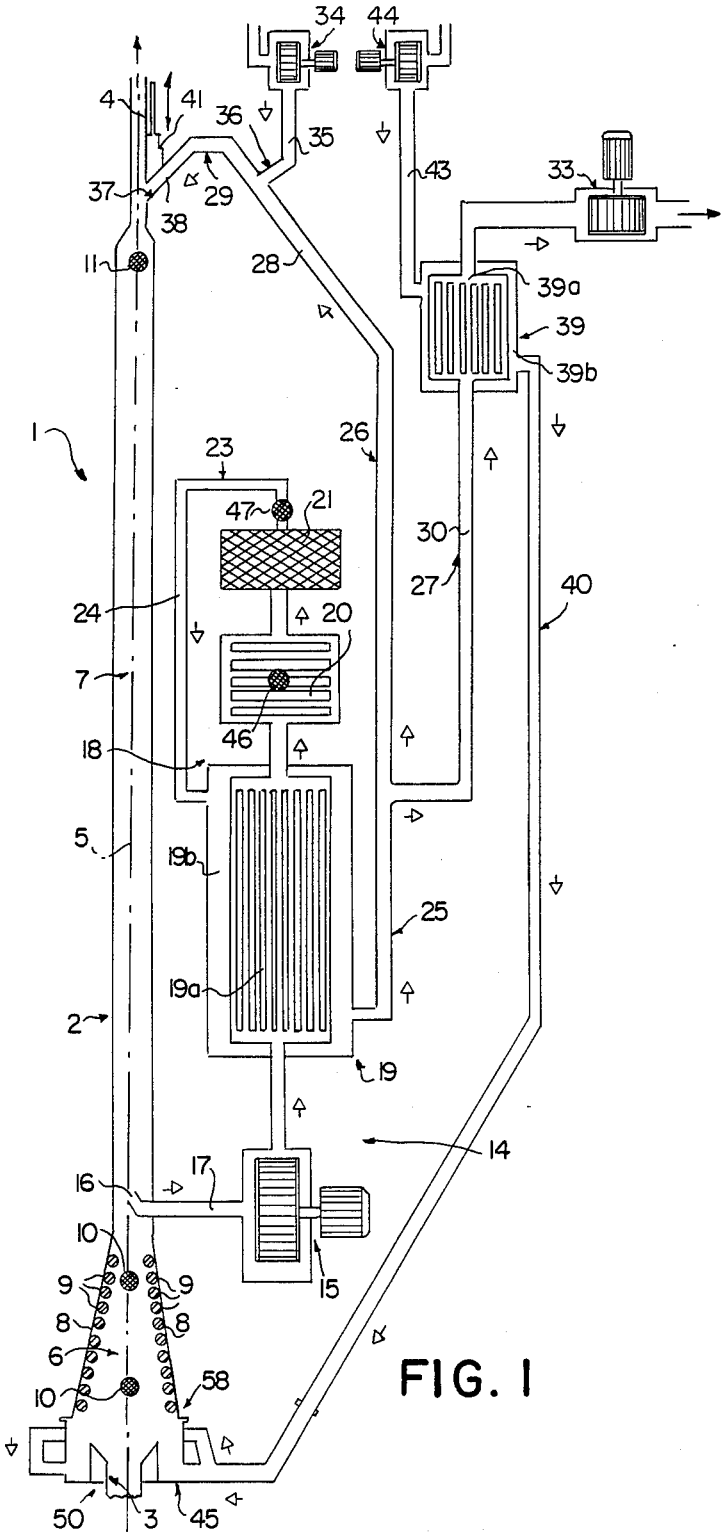
FIG. 1 schematically illustrates a furnace formed according to the principles of the present invention.

With particular reference to FIG. 1, a furnace for firing the insulating plastics resin cladding of electrically conductive copper wires is generally indicated with the reference numeral 1, which furnace comprises, in a known way, a vertical principal chamber 2 provided with a lower inlet opening 3 and an upper outlet opening 4, through which chamber the wire 5 advances longitudinally in a continuous manner. This chamber 2 has an elongate form and comprises a first portion 6 of pyramid section increasing towards the inlet opening 3 and a second portion 7 of substantially constant rectangular section. Along the side walls 8 of the first portion 6 are disposed heating elements 9, conveniently constituted by electrical resistors. Two thermocouples 10 housed in said first portion 6 and a thermocouple 11 housed in the second portion 7 close to the outlet opening 4 detect the temperatures in these portions and constitute the sensors of a temperature regulation system as described hereinbelow.

The furnace 1 further includes an auxiliary unit 14 disposed alongside the principal chamber 2; this auxiliary unit 14 comprises a fan 15 facing an aspiration opening 16 communicating with the principal chamber 2 close to the junction between the two portions 6, 7 of the chamber 2 itself and operable to draw in a first stream 17 of a mixture of air and solvent vapours produced in the first portion 6, and a heating assembly 18. This heating assembly 18 is constituted by a heat exchanger 19, an electrical resistance heater 20, and a catalytic plate combustion chamber 21. A primary circuit **19*a* of the heat exchanger 19, the heater 20 and the combustion chamber 21** are disposed in series downstream of the fan 15. A duct 23 carries a second stream 24 exiting from the combustion chamber 21 to a secondary circuit 19*b* of the heat exchanger 19 in counter current with respect to the primary circuit 19*a* in such a way as to pre-heat the first stream 17 entering the heater 20.

From an outlet duct 25 from the auxiliary unit 14 branch two ducts 26, 27 for conveying a first portion 28 of the second stream 24 towards a recirculation duct 29 for conveying it into the second portion 7 of the chamber 2, and a second portion 30 towards a fan 33 which delivers it to the chimney. A fan 34 draws a first volume of air 35 from the exterior and delivers it into a duct 36 which, together with the first portion 28 of the second stream 24 flowing in the duct 26 flows into the recirculation duct 29 which opens into the second portion 7 of the principal chamber 2 through an aperture 37 which can be closed by a gate valve 41; the arrangement of the recirculation duct 29 is such as to introduce a third stream 38 resulting from the mixture of the first portion 28 of the second stream 24 with said first volume 35 of air in a direction substantially opposite the direction of advancement of the wire 5.

The furnace 1 further includes a second heat exchanger 39 a primary circuit 39*a* of which is disposed in series with said duct 27 and a secondary circuit 39*b* of which, connected to counter current with respect to the first, is disposed in series with a duct 40 which conveys a second volume of air 43 from a fan 44, which draws it from the external environment, to a duct 45 for introduction into the first portion 6 of the principal chamber 2.

Two further thermocouples 46, 47 are disposed respectively in the heater 20 and at the outlet of the combustion chamber 21.

According to the present invention the inlet opening 3 and the introduction duct 45 into the first portion 6 are integrated a single diffuser element 50 illustrated in detail in Figures from 2 to 7.

This diffuser element 50 is conveniently made in sheet metal by conventional metal fabrication operations. The welds have not been represented for simplicity and clarity.

The diffuser element 50 comprises a central body 51 of substantially rectangular form composed of a pair of tubular elements 52, 53 of rectangular section superimposed over one another and defining respective closed ducts 54, 55 of elongate rectangular form. On an upper face 56 of the upper tubular element 52 is welded a frame 57 of sheet metal of greater thickness, into which, in use, is screwed a plurality of screws not illustrated for connecting the element 50 to a peripheral flange 58 (FIG. 1) of the first portion 6 of the principal chamber 2.

On a lower face 59 of the lower tubular element 53 is welded a sheet metal plate 60 provided with a longitudinal aperture 63 which extends over the whole length of the diffuser element 50 substantially along a major median of the diffuser element 50 itself, and has upwardly curved edges 64; at the ends of these edges 64 are welded two respective plates 65 inclined downwardly and towards the center of the diffuser element 50 and together defining the said inlet opening 3. The plate 60 is provided with a plurality of peripheral connecting holes 66 and has a dimension in plan greater than the tubular element 53; in particular it is arranged in such a way that the edges of two of its adjacent sides 67, 68 coincide with the edges of two corresponding sides 69, 70 of the tubular element 53, whilst the remaining two sides project with respect to this latter.

The connection of the plate 60 to a supporting structure of the furnace 1, not illustrated, is achieved by means of a plurality of bolts 71 which engage the said holes 66; in particular the bolts 71 disposed on the sides 67, 68 are housed in the through holes 72 of the tubular element 53, which are coaxial with and superimposed over the holes 66, and their heads are welded to the element 53 itself.

The tubular elements 52 and 53 have internal dividing walls which separate the respective ducts 54, 55 into a plurality of chambers.

Figure 5:
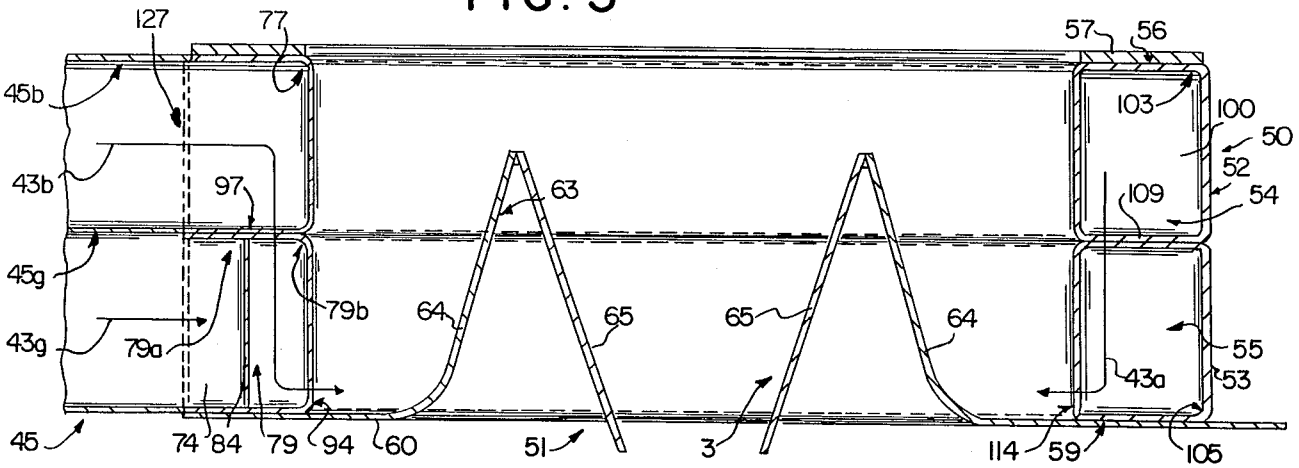

In particular, a wall 74 is disposed vertically and transversely on half of the side 70 of the ducts 54, 55; two walls 75, 76 are disposed on the same side, on opposite sides with respect to the wall 74, and define with it, respectively, two chambers 77, 78 in the duct 54 and two chambers 79, 80 in the duct 55 in superimposed pairs. The chambers 79 and 80 are further divided in a longitudinal sense by a vertical wall 84 in the outer chambers 79*a*, 80*a* and the inner chambers 79*b*, 80*b* (FIG. 5). Two further vertical walls 85 which project obliquely towards the outside from an inner terminal corner of the tubular elements 52, 53 define, with the walls 75, 76 respectively, two further chambers 86, 87 in the duct 54 flanked by opposite sides of the chambers 77, 78, and two further chambers 88, 89 in the duct 55 facing opposite sides of the chambers 79, 80. The walls 75 and 76 do not intercept the entire section of the ducts 54, 55 but are open along the chambers 79*a* and 80*a* which therefore communicate respectively with the chambers 88 and 89. The chambers 88, 79*b*, 80*b* and 89 communicate with the interior of the central element 51 by means of respective lower longitudinal apertures 93, 94, 95, 96. The chambers 77 and 78 communicate with the chambers 79*b* and 80*b* by means of respective apertures 97 in the tubular elements 52 and 53.

The tubular elements 52 and 53 comprise further internal dividing walls along one side 98 opposite the side 70, and in particular a central wall 100 opposite the wall 74 and a pair of side walls 101, 102 opposite the walls 75 and 76. The wall 100 intersects the lower duct 55 and upper duct 54 and divides this latter into two sections 103, 104 lying between the wall 100 and the walls 85; the walls 101, 102 on the other hand only intersect the lower duct 55 and define with the central wall 100 two chambers 105, 106, and with the walls 85 two sections 107, 108. The sections 103, 104 communicate respectively with the chambers 105, 106 through longitudinal apertures 109, 110 of the tubular elements 52, 53; the section 107, the chambers 105, 106 and the section 108 communicate with the interior of the central element 51 through respective lower longitudinal apertures 113, 114, 115, 116 counterposed respectively to said apertures 93, 94, 95, 96.

The inlet duct 45 has an increasing section from an inlet portion 120 of rectangular section and vertical axis, provided with the flange 121 for attachment to the duct 40, and an exit portion 122 peripherally welded to the central element 51 and in particular to the tubular elements 52, 53 along their sides 70.

The duct 45 has three respective internal bulkheads 123 of a form such as to divide each section of the duct 45 transversely into four substantially equal parts, which terminate, in the outlet portion 122 at the inner walls 74, 75 and 76 of the tubular elements 52, 53; the duct 45 further includes a fourth internal bulkhead 124 substantially normal, section by section, to the preceding ones and disposed along a median curved surface of the duct 45 which terminates in the outlet portion 122 substantially at the plane of contact between the tubular elements 52 and 53. The duct 45 is therefore subdivided into eight longitudinal chambers 45*a*, 45*b*, 45*c*, 45*d*, 45*e*, 45*f*, 45*g*, 45*h* as illustrated in FIG. 2.

The tubular element 52 has on its side 70 a pair of terminal apertures 125, 126 which put the chambers 45*a* and 45*d* respectively into communication with the sections 103 and 104, and a pair of central apertures 127, 128 which put the chambers 45*b* and 45*c* respectively into communication with the chambers 77 and 78 of the duct 54; in an entirely similar way the tubular element 53 has on its side 70 a pair of terminal apertures 129, 130 which put the chambers 45*h* and 45*e* respectively into communication with the sections 107 and 108, and a pair of central apertures 131, 132 which put the chambers 45*g* and 45*f* respectively into communication with the chambers 79*a* and 80*a* of the duct 55.

Figure 2:
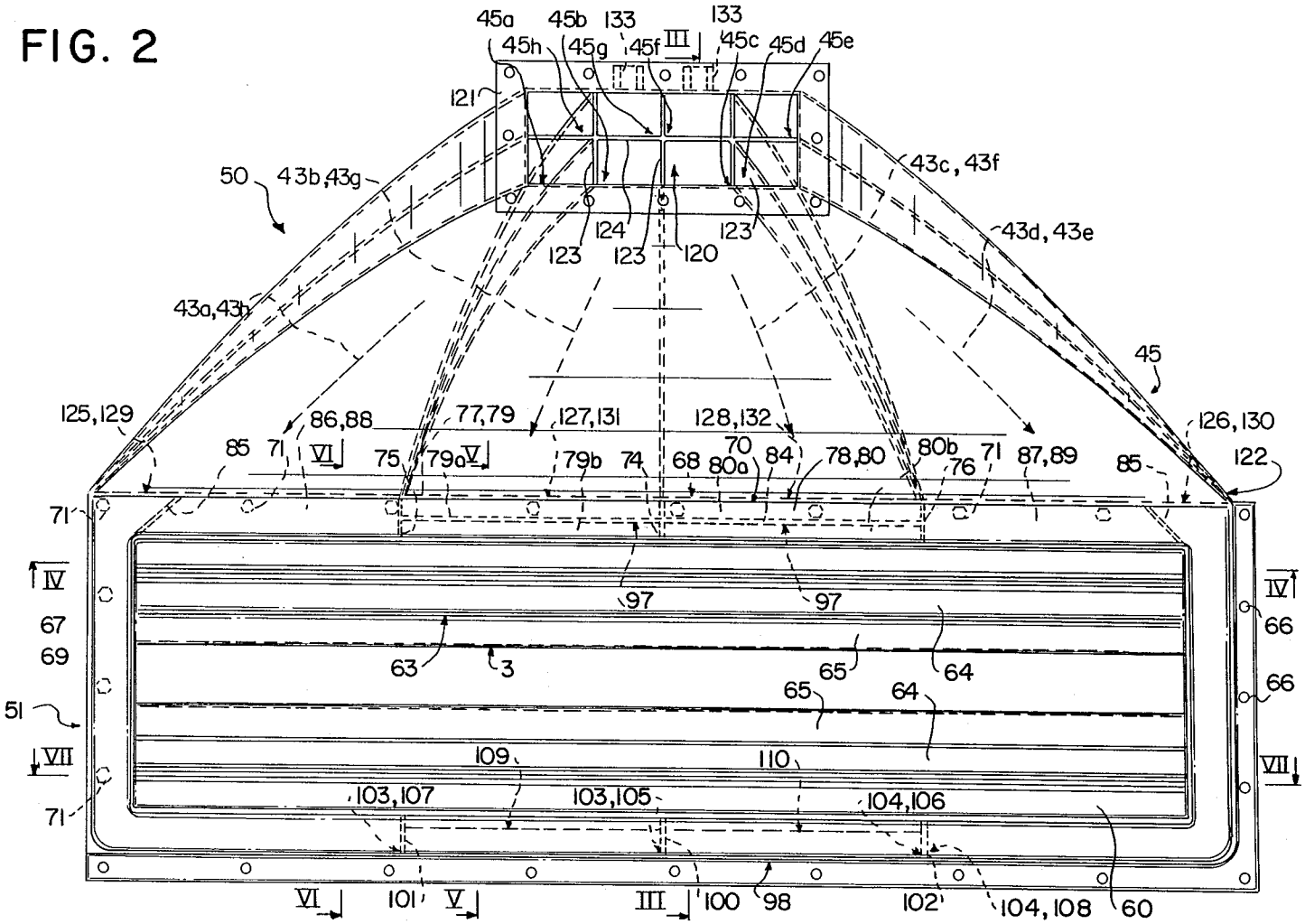
FIG. 2 is a plan view from above of a detail of the furnace of FIG. 1.
Figure 3:
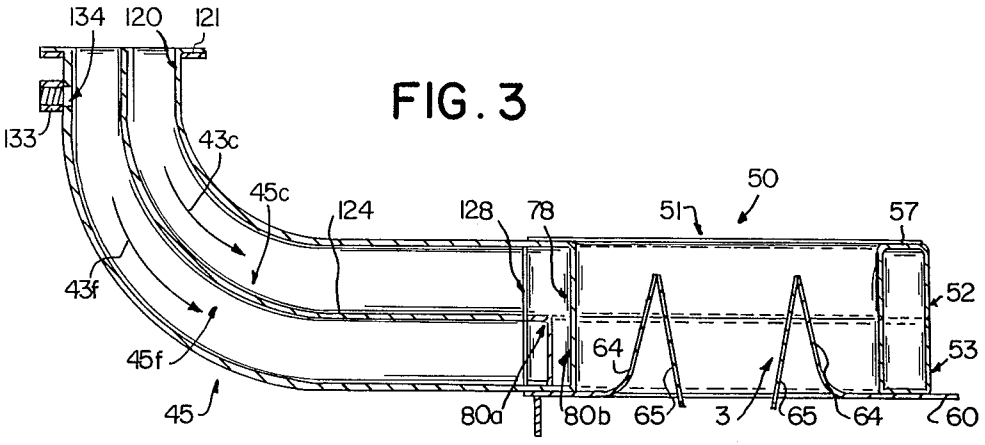
FIGS. 3, 4, 5, 6 and 7 are sections taken respectively, on the lines III—III, IV—IV, V—V, VI—VI, and VII—VII of FIG. 2.
Figure 7:
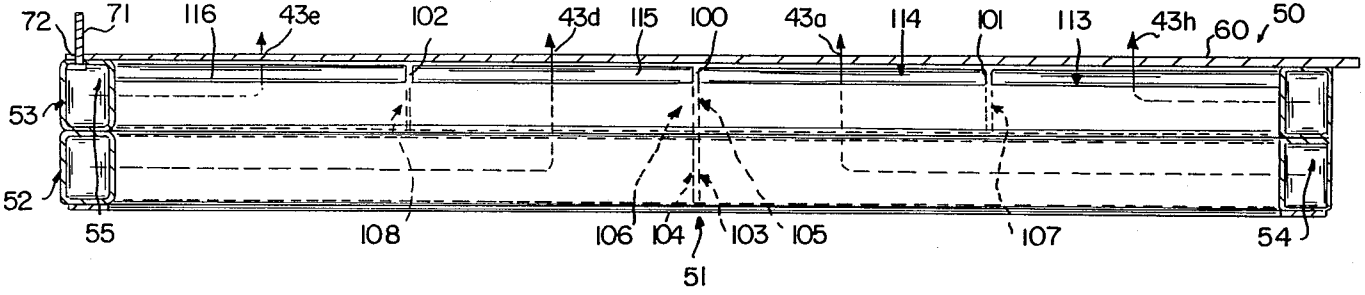
Figure 4:
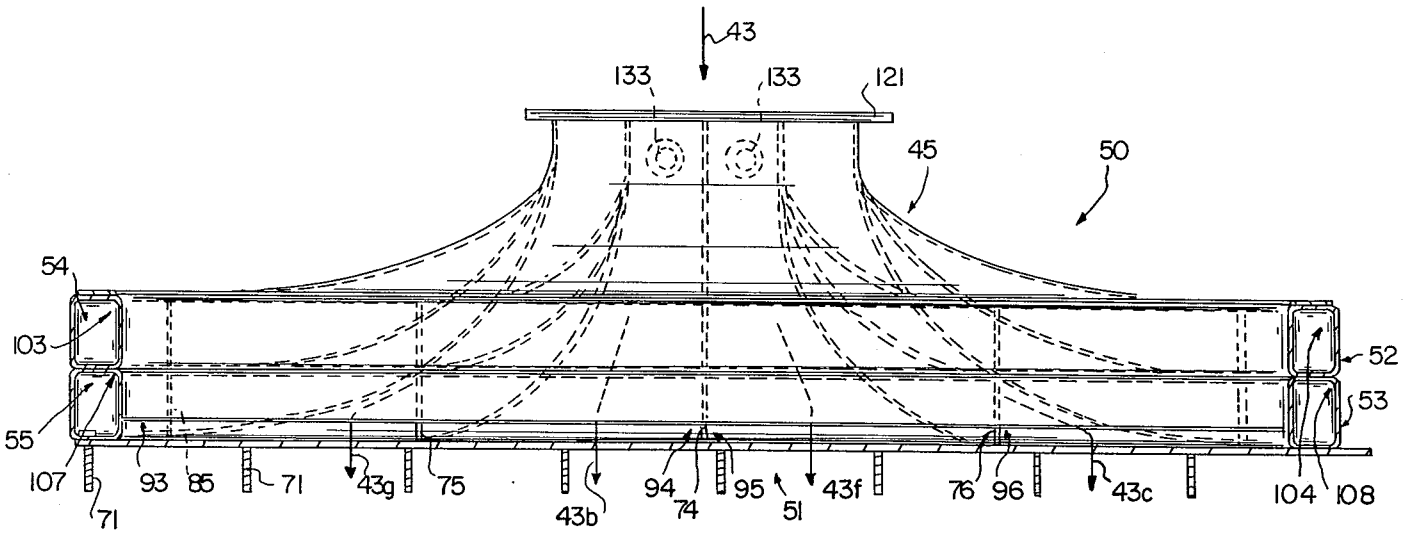

In FIGS. 2, 3 and 4 it is finally seen that on the duct 45 are welded two hollow threaded sleeves 133 in correspondence with respective holes 134 of the duct 45 itself and having the purpose of permitting the connection of fluidodynamic parameter sensing instruments (for example manometers) of the conventional type and therefore not illustrated. The operation of the furnace 1 is as follows.

The wire 5 enters into the peripheral chamber 2 through the inlet opening 3 and passes through the first portion 6 in which evaporation of solvents from the resins which constitute the cladding take place; it then passes into the second portion 7, maintained at a higher temperature than that of the portion 6, in which polymerization and cross linking of the resins take place.

The first stream 17 drawn by the fan 15 and sent to the heating unit 18 is substantially constituted by a mixture of air and solvent vapours. This mixture is first preheated by the heat exchanger 19 and then carried by the heater 20 to a temperature sufficient to trigger combustion of the vapours. The catalytic plate combustion chamber 21 facilitates complete oxidation of these vapours into harmless combustion products (carbon dioxide and steam) which constitute, together with possible excess air, the second stream 24 which yields part of its thermal energy to the first stream 17 in the heat exchanger 19.

This second stream 24 is then divided. The first portion 28, mixed with the air 35 introduced by the fan 34, is introduced in counter current into the second chamber 7 for the dual purpose of controlling its temperature in dependence on values detected by the thermocouple 11 and preventing a heavy flow of hot fluid through the outlet opening 4 by the chimney effect. These effects are controlled both by suitably throttling the aperture 37 by means of the valve 41 and by varying the speed of the fan 34 and therefore the rate of flow of cold air 35.

The second portion 30 of the second stream 24 yields the greatest possible part of its thermal energy to the air 43 and is then sent to the chimney at a relatively low temperature. The air 43 reaches the duct 45 of the diffuser element 50 and is then introduced into the first portion 6 of the principal chamber 2 as described in detail.

The air stream 43 is divided by the bulkheads 123, 124 of the duct 45 into eight streams 43*a*, 43*b*, 43*c*, 43*d*, 43*e*, 43*f*, 43*g*, 43*h* which feed the chambers of the duct 45 indicated with the same reference letters. The description of the path followed by said streams is effected with reference only to one half (the left half in FIG. 2) of the diffuser 50 and can be easily extended to the other half with evident considerations of symmetry with respect to a median vertical plane of the diffuser 50 itself.

The stream 43*a* passes from the chamber 45*a* through the aperture 125 into the section 103 of the duct 54 and flows through it until it encounters the aperture 109 (FIG. 5); it then passes into the underlying chamber 105 and from this, through the aperture 114, to the interior of the central element 51.

The stream 43*b* passes from the chamber 45*b* through the aperture 127 into the chamber 77 and from this into the chamber 79*b* through the aperture 97; finally, via the aperture 94 it flows into the interior of the central element 51.

Figure 6:
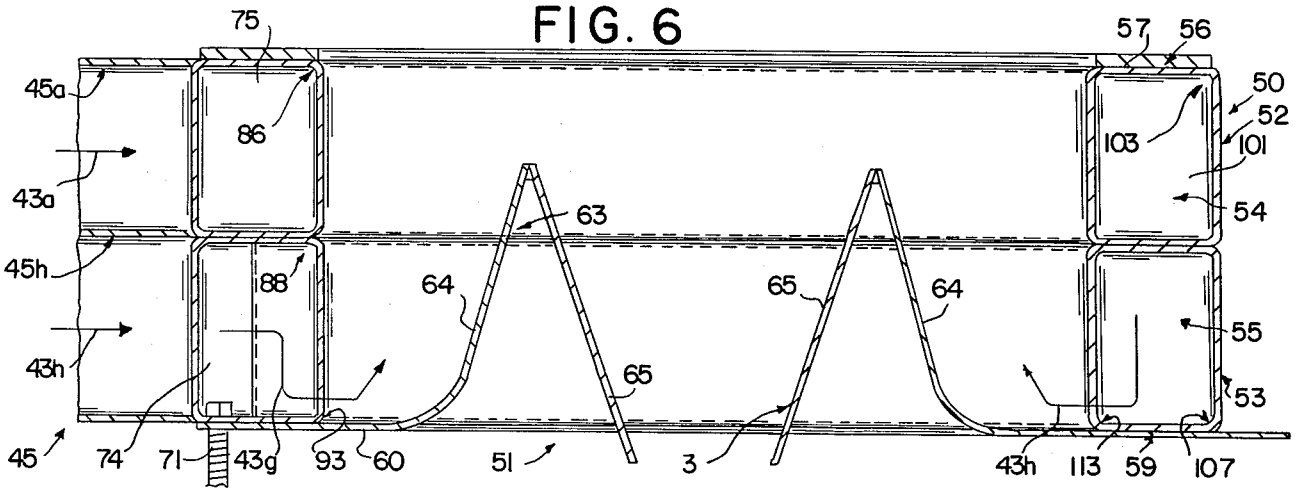

The stream 43*g* enters from the chamber 45*g* into the chamber 79*a* and then into the chamber 88 (FIG. 6) communicating with it, from which it flows out through the aperture 93.

The stream 43*h* passes from the chamber 45*h* in the section 107 of the duct 55 through the aperture 129 and from this it flows to the interior of the central element 51 through the aperture 113.

All the streams are then deflected upwardly by the edges 64 of the aperture 63 of the plate 60 in such a way as to pass into a lateral zone of the first portion 6 of the principal chamber 2; the introduction of the streams into the first portion 6 of the principal chamber 2 takes place with a velocity conveniently less than 1 m/s and preferably about 0.3–0.4 m/s.

The introduction of the stream 43 into the principal chamber 2 achieves the dual purpose of re-using the thermal energy of the second portion 30 of the stream 24 which would otherwise be lost, and of reducing the intake of cold air by the chimney effect from the inlet opening 3.

These effects are controlled, in dependence on the signals from the thermocouples 10, by varying the speed of the fans 44 and 33, that is to say by varying the rate of flow of the second portion 30 of the second stream 24 and cold air 43. Similarly, depending on the temperature values detected by the thermocouples 10, 46, 47 the rate at which heat is provided by the heating elements 9 and by the heating unit 18, as well as the rate of flow of the first stream 17 are varied.

From a study of the characteristics of the furnace 1 formed according to the present invention the advantages which can be obtained thereby are evident.

The particular geometry of the diffuser at the inlet of the first portion 6 of the principal chamber 2 causes a regular introduction of air 43 distributed around the side walls 8 of the portion 6 itself, that is to say avoiding a violent interaction of the air 43 with the cladding of the wire 5.

The speed at which the air 43 is introduced is moreover particularly modest thanks to the expansion of the portion 6 towards the diffuser.

Both the effects allow the temperature of the introduced air 43 to be considerably increased and, therefore, the speed of evaporation of the solvents likewise to be considerably increased without causing surface alterations on the cladding of the wire 5.

Moreover, by regulating the rate of flow of the air 43 the intake of cold air by the chimney effect can be reduced, with consequent reduction in the drop in temperature in the portion 6 from below through the inlet opening 3.

Finally, it is clear that the embodiment described can have modifications and variations introduced thereto without by this departing from the protective scope of the invention.

In particular, the configuration of the furnace installation can be changed; for example, two or more principal chambers can be present, operating at different temperatures; rather than introducing into the first portion 6 of the principal chamber 1 external air 43 heated by means of the heat exchanger 39, all or part of the second stream 24 can be reintroduced, possibly mixed with external air. The points of withdrawal of the first stream 17, the points of introduction of the third stream 38, as well as the elements constituting the heater unit 18 can be changed: the heat exchanger 19 can be omitted, the heater 20 can be a gas heater, the heating elements 9 of the first portion 6 of the principal chamber 2 can be omitted. Finally, the number and forms of the ducts constituting the diffuser element 50 can be changed.

What is claimed:

1. A furnace for firing wire-like products, in particular copper wires clad with plastics resin, of the type comprising:

a principal chamber of elongate form within which said products translate axially in a longitudinal direction between an inlet opening and an outlet opening, said principal chamber defining a first portion in which evaporation of solvents from the plastics resin takes place and a second portion in which polymerization and cross linking of the plastics resin take place;

an auxiliary unit including an aspiration opening communicating with said principal chamber, means for aspirating a first stream of air and solvent vapours from said principal chamber and means for heating said first stream to cause combustion of the said vapours to form a second stream exiting from said auxiliary unit;

means for introducing of a gas stream into the first portion of said principal chamber;

characterized by the fact that the means for introduction of the gas stream (43) comprises: a diffuser (50) provided with separator means (45) operable to divide the gas stream (43) into a plurality of partial streams **(43*a*, 43*b*, 43*c*, 43*d*, 43*e*, 43*f*, 43*g*, 43*h*), means (52, 53) for distribution of the said partial streams (43*a*, 43*b*, 43*c*, 43*d*, 43*e*, 43*f*, 43*g*, 43*h*) and means for introduction of the partial streams (43*a*, 43*b*, 43*c*, 43*d*, 43*e*, 43*f*, 43*g*, 43*h*) into a peripheral region of the first portion (6) of said principal chamber (2) in a direction substantially parallel to at least one lateral surface (8) of the first portion (6)**.

2. The furnace according to claim 1, characterized by the fact that the first portion (6) of the principal chamber (2) has a section increasing towards said diffuser (50).

3. The furnace according to claim 1, characterized by the fact that said separator means (45) is provided with at least one internal bulkhead (123, 124) which defines a plurality of axial chambers **(45*a*, 45*b*, 45*c*, 45*d*, 45*e*, 45*f*, 45*g*, 45*h*)**.

4. The furnace according to claim 3, characterized by the fact that the means for distribution comprises at least on tubular element (52, 53) defining a closed circuit duct (54, 55) which is provided with a plurality of outer apertures (125) communicating with said axial chambers **(45*a*, 45*b*, 45*c*, 45*d*, 45*e*, 45*f*, 45*g*, 45*h*) of said separator means (45)**.

5. The furnace according to claim 4, characterized by the fact that said introduction means includes a plurality of apertures (93, 94, 95, 96, 103, 104, 105, 106) within the said tubular element (53) disposed along opposite sides (70, 98) and deflector means (64) operable to deflect the said partial streams **(43*a*, 43*b*, 43*c*, 43*d*, 43*f*, 43*g*, 43*h*)** upwardly.

6. The furnace according to claim 5, characterized by the fact that said means for distribution includes two superimposed tubular elements (52, 53), and by the fact that the said outer apertures (125, 126, 127, 128, 129, 130, 131, 132) are formed on the lower (53) of the said tubular elements (52, 53) along two opposite sides (70, 98) thereof; said tubular elements (52, 53) having a plurality of internal dividing walls (74, 75, 76, 85, 100, 101, 102) and mutual communication apertures (97, 109, 110) defining a plurality of chambers (77, 78, 79, 80, 86, 87, 88, 89, 103, 104, 105, 106, 107, 108) communicating with said outer apertures (125, 126, 127, 128, 129, 130, 131, 132) and with said inner apertures (93, 94, 95, 96, 103, 104, 105, 106).

7. The furnace according to claim 1, characterized by the fact that the furnace further comprises first aspiration means (34) for aspiration of a first volume of air (35) from an external environment: means (29) for introduction to the said principal chamber (2) of a mixture (38) of the first volume (35) of air and a first portion (28) of the second stream (24) exiting from said auxiliary unit (14); and means (27, 33) for transferring a second portion (30) of the second stream (24) to a chimney.

8. The furnace according to claim 7, characterized by the fact that said means for introduction of a gas stream includes means for drawing a second volume (43) of air from the external environment.

9. The furnace according to claim 8, characterized by the fact that the furnace further includes heat exchange means (39) for exchanging heat between said second portion (30) of the said second stream (24) and the second volume (43) of air.

10. The furnace according to claim 9, characterized by the fact that said heat exchange means (39) includes a primary circuit **(39*a*) which is connected in series with the said means (27) for transferring said second portion (30) of the said second stream (24) to the chimney, and a secondary circuit (39*b*) which is connected in series with said diffuser (50)**.

11. The furnace according to claim 7, characterized by the fact that the said means for introduction to the principal chamber of the mixture (38) of the first volume (35) of air and the said first portion (28) of the said second stream (24) comprises a duct (29) communicating with the second portion (7) of said principal chamber (2).

12. The furnace according to claim 11, characterized by the fact that said duct (29) communicates with the second portion (7) of the said principal chamber (2) through an aperture (37) closable by flow rate limiting means (41).

13. The furnace according to claim 11, characterized by the fact that the said duct (29) introduces the mixture (38) into the second portion (7) of said principal chamber (2) close to the said outlet opening (4) from the said principal chamber (2) and in a direction substantially opposite to the direction in which said products translate in said principal chamber (2).

14. The furnace according to claim 1, characterized by the fact that said furnace further includes heater means (9) housed in the first portion (6) of the said principal chamber (2).

15. The furnace according to claim 1, characterized by the fact that said principal chamber is vertically oriented.

* * * * *